United States Patent [19]

Weischedel

[11] 4,074,182

[45] Feb. 14, 1978

[54] POWER SUPPLY SYSTEM WITH PARALLEL REGULATORS AND KEEP-ALIVE CIRCUITRY

[75] Inventor: Richard C. Weischedel, Camillus, N.Y.

[73] Assignee: General Electric Company, Syracuse, N.Y.

[21] Appl. No.: 746,398

[22] Filed: Dec. 1, 1976

[51] Int. Cl.[2] ..... G05F 1/56; G05F 1/58

[52] U.S. Cl. ..... 323/25; 307/82; 323/DIG. 1

[58] Field of Search ..... 307/44, 52, 53, 64, 307/82; 323/9, 17, 23, 25, DIG. 1

[56] References Cited

U.S. PATENT DOCUMENTS

| | | | |
|---|---|---|---|
| 3,549,977 | 12/1970 | Watkins | 307/82 X |
| 3,808,452 | 4/1974 | Hutchinson | 307/64 |
| 3,824,450 | 7/1974 | Johnson et al. | 323/23 |
| 3,890,559 | 6/1975 | Kuster | 323/25 X |
| 4,013,938 | 3/1977 | McCoy | 307/82 X |
| 4,035,716 | 7/1977 | Hutchinson | 323/25 X |

OTHER PUBLICATIONS

Comins, "Adding a Backup Supply Doesn't Ensure a Redundant Power System", Engineering Design News (EDN), Oct. 5, 1975, pp. 36–40.

*Primary Examiner*—A. D. Pellinen
*Attorney, Agent, or Firm*—Carl W. Baker; Richard V. Lang; Frank L. Neuhauser

[57] ABSTRACT

A dc power supply system comprising two or more voltage regulator units connected in parallel to a common load, there being at least one more regulator unit provided than is required to meet the rated load current requirement. The spare or redundant regulator assumes the load automatically if another regulator fails, and does so in a manner such that it does not interfere with operation of other regulators when they are operating normally and such that its own operation is not affected by the others in the event of their failure. To these ends the power supplies include a decoupling network which is associated with each of the regulators and which operates to prevent any reverse flow of current to that regulator, thus isolating it in the event of its failure, and they include also keep-alive circuitry which forces the redundant or spare power supply to produce an output at all times, to thus enhance its capability to pick up the load instantaneously and with minimized transient in load voltage should one of the other regulators fail.

9 Claims, 3 Drawing Figures

POWER SUPPLY SYSTEM WITH PARALLEL REGULATORS AND KEEP-ALIVE CIRCUITRY

BACKGROUND OF THE INVENTION

The U.S. Government has rights in this invention pursuant to Contract No. DAHC60-72-C-0080 awarded by the Department of the Army.

This invention relates to direct current power supplies and more particularly to such supplies which incorporate a plurality of parallel connected regulators of which at least one is redundant in the sense that it assumes part or all of the load current requirement only in the event of malfunction of another regulator.

The achievement of high reliability by the design of such redundancy into direct current power supplies is generally known, being described, for example, in an article by James Comins entitled "Adding a Backup Supply Doesn't Ensure a Redundant Power System", which appeared in the magazine *Engineering Design News* for Oct. 5, 1975, beginning on Page 36. Other systems using parallel voltage regulator units with diode decoupling of units or keep-alive provision for standby units are described in U.S. Pat. Nos. 3,808,452 to Hutchinson and 3,824,450 to Johnson et al.

The voltage regulator units which find application in the power supply systems of the present invention are conventional regulators of the kind widely sold commercially in module form, and may be of either series or switching type. Standard regulators of both these types normally comprise a "sensor" or control input to which a voltage feedback signal is applied for controlling the output of the regulator to maintain the desired output voltage. If the voltage feedback to this sensor input exceeds an internal voltage reference the power supply will turn off and no current will flow; if the voltage across the sense leads is less than the internal voltage reference the regulator module will turn on, supplying its maximum current output until the voltage across the sense leads again equals the internal voltage reference. The sense leads can be remoted so that regulation is maintained at a distant point, i.e., directly across the load itself rather than at the regulator output terminals. This avoids errors due to voltage drop along the power leads.

Where redundancy is accomplished by provision of more regulator units than are required to meet the load current requirement, it is desirable to remove a failed regulator unit from the circuit in some manner so as to prevent reverse flow of current through it. This can be accomplished by connecting an isolation or decoupling diode in one or both of the power leads between the regulator and load, or polarity permitting current flow to the load but blocking any reverse current flow in the event of regulator failure.

Additionally, to enable the spare regulator units to assume the load current requirement quickly and with as small a transient as possible, it has been proposed to provide keep-alive circuitry for one or more of the voltage regulator units. Such circuitry operates to cause the unit or units then in standby status, i.e., not actually supplying the load, to produce and maintain a voltage output somewhat less than the voltage output of the other units actually supplying the load. Otherwise the standby regulator would tend to turn itself off, because the load voltage applied to its sense input is higher than its internal reference. The circuitry for accomplishing such keep-alive function may take different forms two of which are described in the Comins article and Johnson et al patent.

The present invention is directed to power supply systems of the kind just described, affording significantly improved operation in several important respects. More particularly, these systems provide enhanced reliability through novel combinations of circuitry for effectively isolating any failed regulator from the load, with circuitry for "exercising" or maintaining voltage output of any regulator presently not supplying output to the load so as to assure its readiness to supply load output when needed, and they may desirably also include circuitry for effecting common adjustment or trim of the load voltage and for monitoring the performance of each of the regulators. While control circuitry in accordance with the invention may be used to advantage with series regulators, and exemplary circuitry is herein shown and described in one embodiment incorporating series regulators, it offers particular advantage as applied to switching regulators. Since the pulse width modulation which is characteristic of the operation of switching regulators requires their periodically being switched between full load voltage and zero voltage, conventional keep-alive circuitry which requires a steady or averaged value of regulator output voltage for its operation does not readily lend itself to this application. In accordance with the invention, such averaging function is provided within the keep-alive circuitry itself, and that circuitry serves additionally to "exercise" the standby regulator periodically to assure its capability to accept load transfer, with minimum power consumption on standby.

BRIEF SUMMARY OF THE INVENTION

This invention has as its principal objective the provision of power supply systems including a plurality of either series regulator units or switching regulator units connected in parallel and providing full redundant operation by inclusion of at least one spare or standby regulator unit together with means for bringing that unit automatically into operation as needed upon failure of another unit or units. Also provided are keep-alive means for maintaining the spare or standby unit always in condition to assume the load quickly and automatically when needed, and means for isolating failed units so that irrespective of their failure mode they do not interfere with continued operation of the system. Additionally, power supply systems of the invention may provide a monitor function for detecting and indicating a failure of one or more of the voltage regulator units so that the operator may have such failures called to his attention notwithstanding the fact that system operation continues to meet the load requirement by exercise of its in-built redundancy.

The keep-alive function is provided by a diode-resistor network connected to the load conductors on the input side of the decoupling diode and to the load, in an arrangement such that the keep-alive voltage control operates to maintain the associated voltage regulator at a predetermined voltage level below that necessary to maintain the load at its set voltage point. Additionally, the circuitry through which this keep-alive function is performed may be arranged to enable common adjustment of the operating voltage point for all of the voltage regulator units of the system, to enable precise adjustment of load voltage and simultaneous adjustment of all of the regulators to maintain it.

As previously indicated, the control and monitor circuitry of the invention lends itself to use with voltage regulator units of both switching regulator and series regulator type. The power supply circuits of the invention also are adaptable to use with systems spanning a wide voltage range, providing interchangeability of control circuits and modules as necessary to accommodate widely different load voltage requirements with only minor adjustments to or changes in the circuit components being necessary to adapt to the particular voltage range required.

BRIEF DESCRIPTION OF THE DRAWINGS

The invention will be further understood and its various objects, features and advantages more fully appreciated by reference to the appended claims and to the following detailed description when read in conjunction with the accompanying drawings, wherein:

DETAILED DESCRIPTION OF THE INVENTION

Figure 1:
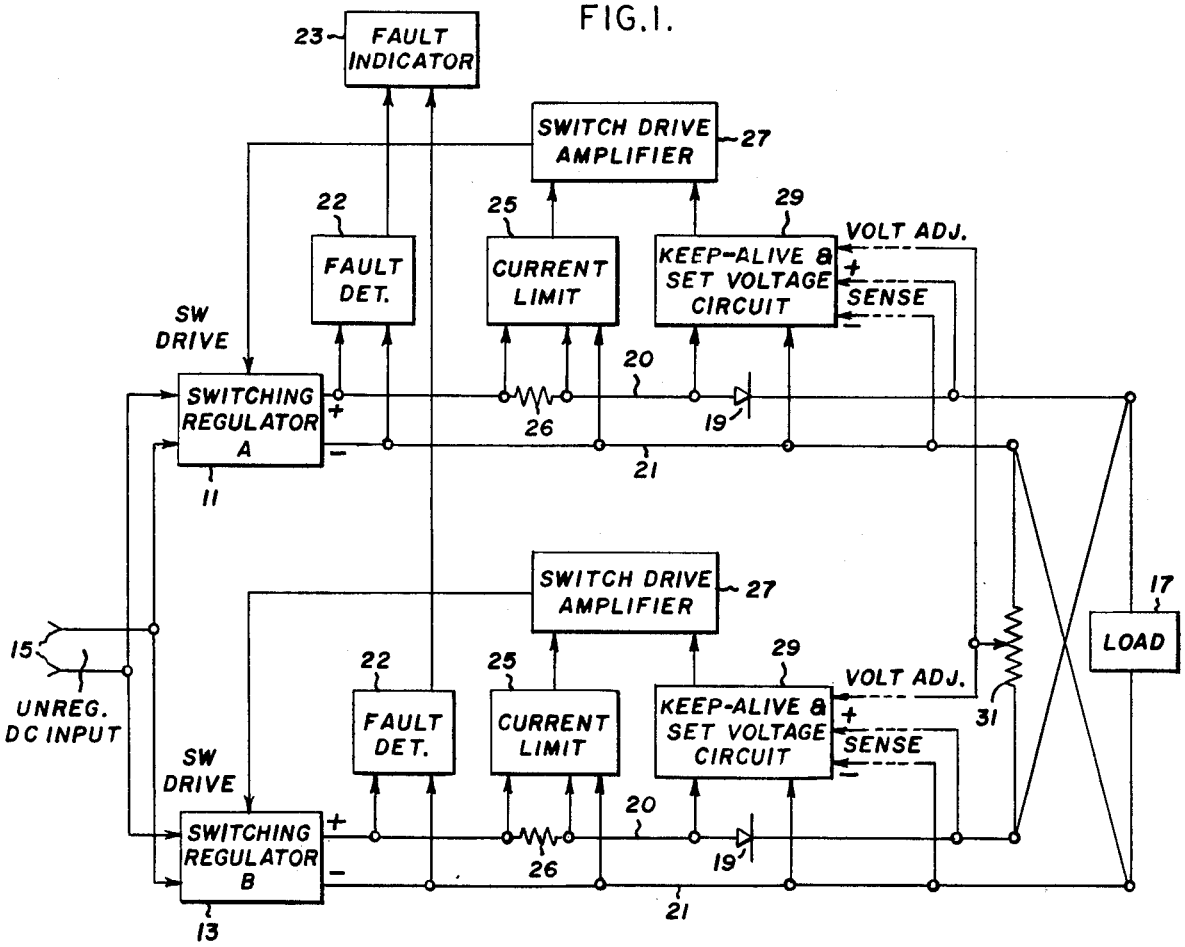
FIG. 1 is a block diagram of a power supply system incorporating a plurality of parallel-connected switching type voltage regulators and control and monitor functions in accordance with the invention.

With continued reference to the drawings, FIG. 1 illustrates a power supply system incorporating voltage regulator units of switching type. While only two voltage regulator units 11 and 13 are shown, it will be understood that the number of units or modules will vary depending upon the needs of the particular application, the only requirement being that there be at least one more unit than is necessary to maintain the desired load current with all the units in operation. Thus to provide the desired redundancy with a two-regulator system as illustrated, each of the two regulator units must be capable of supplying the entire load. The voltage regulators themselves may be standard commercial units of either switching regulator type or series regulator type, as will be described hereinafter.

The voltage regulator units 11 and 13 shown receive an unregulated dc voltage input by way of terminals 15, and provide their regulated voltage output to a common load 17. The two regulators are connected in parallel circuit relation with each other, with an isolation diode 19 interposed between each of the regulators and their common load. These diodes may be connected in either the positive output leads 20 or the negative leads 21 of the regulators, with their polarities and that of other polarity sensitive circuit elements in the control circuitry to be discussed being arranged accordingly.

As indicated in block diagram form in FIG. 1, this control circuitry generally includes, for each of the two regulators, a fault detect circuit 22 providing an output signal to a fault indicator 23 upon failure of the regulator to maintain an average voltage output above a predetermined value, and a current limit circuit 25 which includes a current sensing resistor 26 and responds to overcurrent through that resistor to apply a control signal to the voltage regulator switch drive amplifier 27, thereby to limit its current output. In a multiple regulator system this current limit serves in known manner also to bring into load-supply operation such number of the regulators as needed to meet the total load current requirement.

This switch drive amplifier 27 also accepts as a second control input the signal output of the keep-alive and set voltage circuit 29. This circuit performs its keep-alive function by maintaining the associated regulator in an operative state with its average voltage output at some point below that at which the regulator operates fully loaded, thus enabling a regulator previously on standby to assume the load immediately and with reduced voltage transient upon transfer of the load from the regulator previously carrying it. In accomplishing this keep-alive function the circuit serves also to "exercise" the non-loaded or standby regulator by causing the regulator periodically to switch through its operating cycle even though not loaded.

Additionally this circuit provides means for adjusting the voltage output of both regulators, or all regulators where the system includes more than two, for purposes of adjusting or trimming their common output to the desired load voltage level. Such voltage adjust function is obtained by varying a control voltage which is provided by a potentiometer 31 connected to any convenient voltage source, as by connection across the load 17 as shown. Potentiometer 31 provides a common control input to the keep-alive and set voltage circuit 29 for each of the regulators.

The details of circuitry of the several control subsystems just named will be further described with reference to FIG. 2. It may be noted here, however, that not withstanding the common control of the voltage output of the several regulators 11–13, there normally will exist some small differences between their respective output voltages. Whichever of the units is producing the higher voltage will supply the entire load requirement, up to the rated current limit of that regulator, and will continue to do so as long as the system is operating normally.

In the event the load-carrying regulator should fail for any reason to provide adequate current to maintain the called-for load voltage, this condition will immediately be sensed and the redundant or standby regulator then immediately picks up the load. If the failure mode happens to be such as to result in overvoltage at the load, this could be sensed by conventional overvoltage protection means (not shown) which would operate to disable the unit producing such overvoltage by placing across its output a short or "crowbar" cutting it off from the load and bringing the standby regulator into play. Such overvoltage protection is actually not required in the invention as illustrated in FIG. 2, however, because in this system the overvoltage condition resulting from a "full on" failure of one regulator will cause all the others to turn off, and the output of the failed regulator then is self-limiting either by reason of its internal impedance or by operation of fusing or like protective devices on its input.

Figure 2:
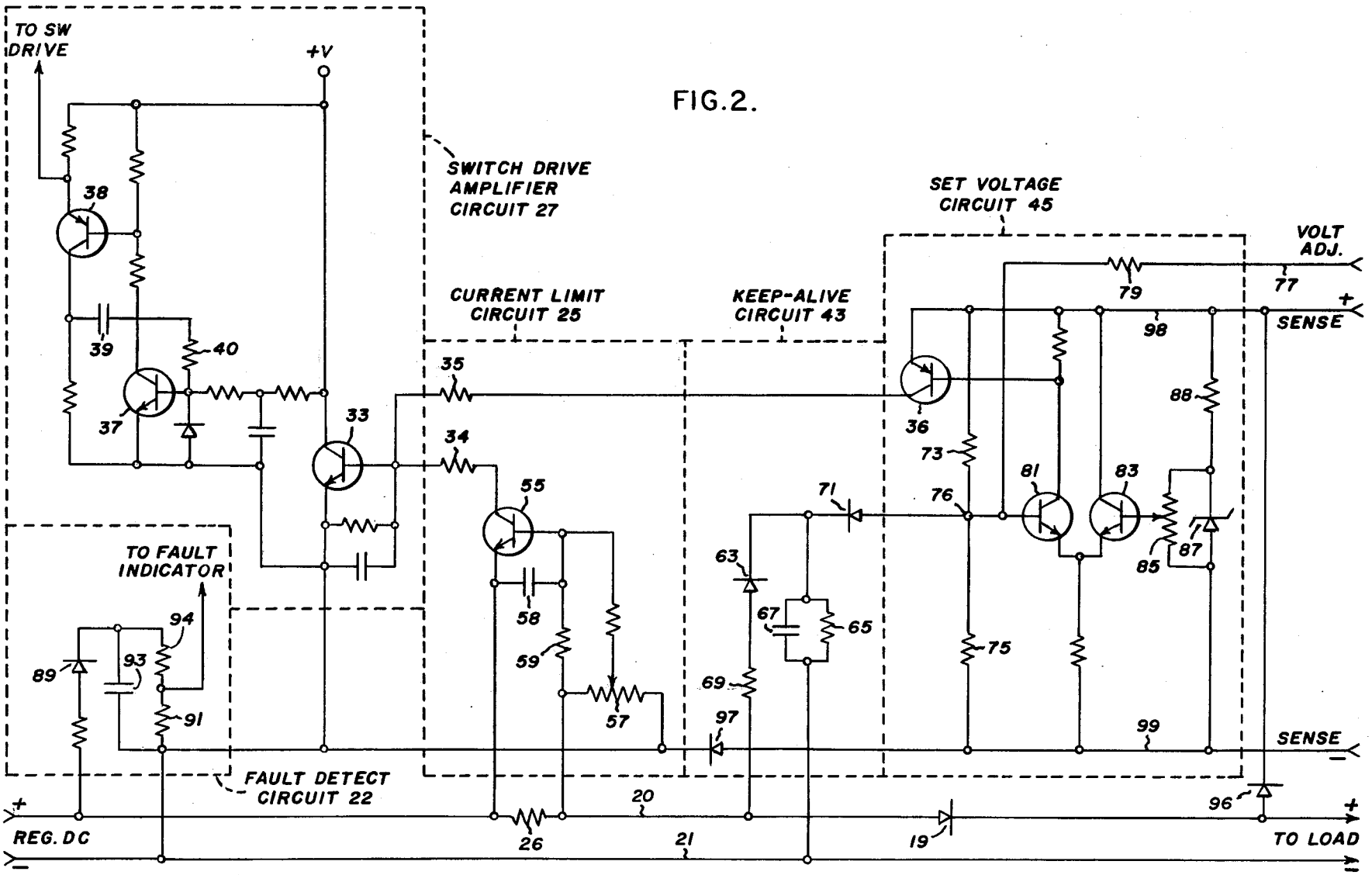
FIG. 2 is an elementary circuit diagram of certain of the control and monitor subsystems of FIG. 1.

Turning now to FIG. 2, the regulator switch drive amplifier circuit 27 is here shown to comprise a transistor 33 which has as one of its two signal inputs the output of current limit circuit 25. The other such input is a voltage control signal from the keep-alive circuit 43 and set voltage circuit 45, which provide such control signal input to transistor 33 through a transistor 36. Resistors 34 and 35 are interposed in the inputs to transistor 33 to provide isolation and level equalization for the current limit and voltage control signals, respectively.

The control signal output of transistor 33 is coupled to a switch drive input of the associated voltage regulator unit through a two-stage amplifier comprising transistors 37 and 38. The former of these is enclosed within a positive feedback loop including an RC network comprising capacitor 39 and resistor 40. The operation of this feedback is to hold transistor 37 off, when it is switched off by transistor 33, through at least a fixed time period of duration determined by the time constant of the RC network. This fixes the minimum width of the regulator PWM output pulse which in turn determines the maximum switching rate of the regulator; this typically may be of the order of a few kiloherz when operating under load. The regulator output pulse width may of course be broader than the minimum thus determined, if the set voltage output still is calling for more voltage and is continuing to hold transistor 33 switched on.

The current limit signal previously mentioned is generated across a current sensing resistor 26 connected in the positive load supply line 20. The voltage drop across this resistor provides a measure of load current flow, and is base-emitter coupled to a transistor 55, to which a controllable bias is applied by a potentiometer 57. This potentiometer may conveniently be connected as shown across the regulator output so as to derive the bias voltage by voltage division of the load voltage. Adjustment of potentiometer 57 enables control of the value of load current at which transistor 55 switches on to produce a current limit signal to the switch drive amplifier circuit 27. The RC combination 58-59 shown serves to prevent transistor response to brief fluctuations in load current.

The keep-alive circuit 43 operates to sense the voltage across the regulator output leads, at a point on the regulator side of the decoupling diode 19, and to limit the magnitude of the difference between that voltage and the voltage at a reference or control point. This is accomplished by provision of a diode 63 connected in series circuit relation with a resistance-capacitance network 65–67 across the load conductors 20 and 21, with the connection to conductor 20 in which the decoupling diode 19 is located being on the input side of that diode as shown. Another resistor 69 may be provided in series with the resistance-capacitance network 65-67 for limiting the magnitude of current flow into capacitor 67, and also for limiting current flow through that capacitor in the event it should short.

The operation of the keep-alive circuit is to cycle or "exercise" the regulator periodically by switching it on when the voltage across the regulator falls below some predetermined level and remains below that level for a time period controlled by the time constant of the RC network 65–67. The values of the capacitance 67 and resistance 65 are selected to be such that the time constant of the network comprised thereby is appropriately matched to the switching characteristics of the associated voltage regulator. Typically, for example, the discharge time constant for this network will be such as to effect switching of the regulator, when operating standby and not under load, at a switching rate which is some fraction of the regulator switching rate under load.

Between the diode 63 and RC network 65–67 there is connected the anode of a diode 71 having its cathode connected between two resistors 73 and 75 constituting a voltage divider. This connection point, at 76, may be termed a voltage control point, since as will be explained a corrective reaction will occur to any departure from a design value of the voltage level existing here, whether such departure is occasioned by operation of the keep-alive circuitry just described, or by change in load voltage when the regulator is supplying the load, or by change in the voltage adjust input which also connects to this point via conductor 77. A resistor 79, of resistance value several times higher than that of the resistors comprising divider network 73–75, is connected in conductor 77 as shown to limit the sensitivity of the control voltage at connection point 76 to small changes or variations in the voltage adjust input. Resistor 79 serves also to limit current flow in the event of a short circuit or other failure in the set voltage circuit.

The control voltage at the point 76 is applied as one input to a differential amplifier comprising transistors 81 and 83, with the amplifier output being applied to the base of transistor 36. The other input to the differential amplifier is a reference voltage provided by a potentiometer 85 connected across a constant voltage source which conveniently may be constituted by a zener diode 87 and series resistor 88 connected between the positive and negative "sense" leads. The operation of this differential amplifier is such that whenever the voltage at the control point decreases, whether due to change in load voltage, to signal input from the keep-alive circuit 43 or to change in the control voltage input from the voltage adjust lead 77, the differential amplifier will generate a control signal output through transistor 36 to the switch drive amplifier circuit 27 to switch the regulator on and thus commence a switching cycle.

The switching rate and regulator output pulse width will depend on the operating state. If the regulator is on standby or only lightly loaded the pulse width will be the minimum determined by the time constant of the RC network 39–40; if the regulator is substantially but not fully loaded it will remain on until the load voltage across voltage divider 73–75 reaches the set value, at which point the differential amplifier output will trigger it off; and if the regulator is fully loaded it then will operate under control of the current limit as previously described. The output pulse rate when operating under load will be determined by load demand but is subject to the maximum limit determined by RC network 39–40; operating on standby the pulse rate is determined by the discharge time constant of the RC network 65–67, and as previously noted may desirably be relatively low as for example a few hundred herz.

For purposes of fault detection and monitoring, there is provided a second diode-resistor network comprising a diode 89, resistor 91 and capacitor 93, the latter two elements being in parallel with each other and in series with the diode across the regulator output in an arrangement similar to that of the keep-alive circuit. Another resistor 94 may be included here for purposes of adapting the monitor to regulators of different voltage ratings. In the event of any failure of the regulator, the voltage at the point between diode 89 and resistors 91 and 94 will drop and such change in voltage will be communicated to the fault indicator 23 previously described.

The capacitor 93 serves here to prevent fault indicator response to the voltage fluctuations which are normal to the operation of the keep-alive circuitry previously described. To this end, the capacitor 93 should be of value such that the resistance-capacitance network of which it forms part has a discharge time constant which is relatively long as compared to that of the network 65–67. The fault detect circuit then will be insensitive to the voltage swings attributable to the regulator's being switched on and off at the normal keep-alive switching rate. From the apparent similarity of the fault detect and keep-alive circuit elements it is believed apparent that these circuits could be combined if desired. Separation of the circuits as illustrated generally is to be preferred, however, to assure against sensitivity of the keep-alive control circuitry to any noise which may be picked up by the fault indicator output lines, and also to enable isolation of the fault indicator response from keep-alive circuit operation as just explained.

While not essential, diodes 96 and 97 preferably are provided respectively connecting the positive and negative "sense" leads 98 and 99 to the positive and negative load supply lines 20 and 21 as shown. Such connection serves two purposes. First, it enables operation of the regulator in standby mode for test or other purposes even when the regulator is not connected to a load, i.e., when the load supply leads are open-circuited. Secondly, it causes the voltage control to respond to whichever is the higher of the "sense" and load voltages, to thus better protect against an overvoltage condition whether caused by the particular regulator with which that control is associated or by another.

Operation of the circuit of FIG. 2 is believed clear from what has already been said regarding the functions of its various elements. In brief, the keep-alive circuit 43 has no effect on the voltage regulator so long as the regulator is supplying current to the load and is maintaining its set output at the control point by switching on and off. Under these conditions the capacitor 67 is charged through diode 63 and resistor 69 to a voltage higher than the control voltage at point 76, and there accordingly will be no current flow through diode 71. The keep-alive circuitry then does not affect the control voltage at point 76.

If the regulator is not supplying current to the load, capacitor 67 will begin to discharge through resistor 65. When the voltage across the capacitor drops below the control value, current then will flow through diode 71 reducing the control voltage and thereby generating, through differential amplifier 81–83, an output to transistor 36. That transistor will switch on and cause the switch drive amplifier 27 to switch the regulator on and thus recharge capacitor 67 to a voltage level such that diode 71 again is back biased.

As previously noted, the capacitance-resistance network 65–67 has a fast charge time constant and a slow discharge time constant. When the regulator is switched on by the keep-alive circuit its voltage output rises quickly to a voltage above the control voltage point and the regulator then turns off. The slow discharge resistor starts discharging the capacitor 67, and when the regulator output voltage drops below the reference voltage the regulator then is again turned on, to thus "exercise " the regulator and maintain voltage output even though the regulator is supplying no external load current. The output voltage is maintained at the value determined by the setting of the voltage control point at 76, but because when operating in the standby or keep-alive mode the control voltage is compared against the regulator output voltage rather than against the load voltage, the regulator output voltage will average less than the normal load voltage.

In the particular embodiment illustrated, the standby or keep-alive voltage output may average somewhat less than half the normal operating voltage. This is adequate to "exercise" the voltage regulator and its control circuitry, to enable operation of the monitor circuitry, and to reduce to an acceptable level the transients in load current which result upon failure of one of the other units and assumption of the load by a unit previously on standby. If it is desired to reduce the differential in voltage between the load voltage and the standby regulator output voltage this is possible in accordance with the invention by modification of its circuitry as shown in FIG. 3, which illustrates also the application of the invention to a series type regulator as opposed to the switching regulator of FIGS. 1 and 2.

Figure 3:
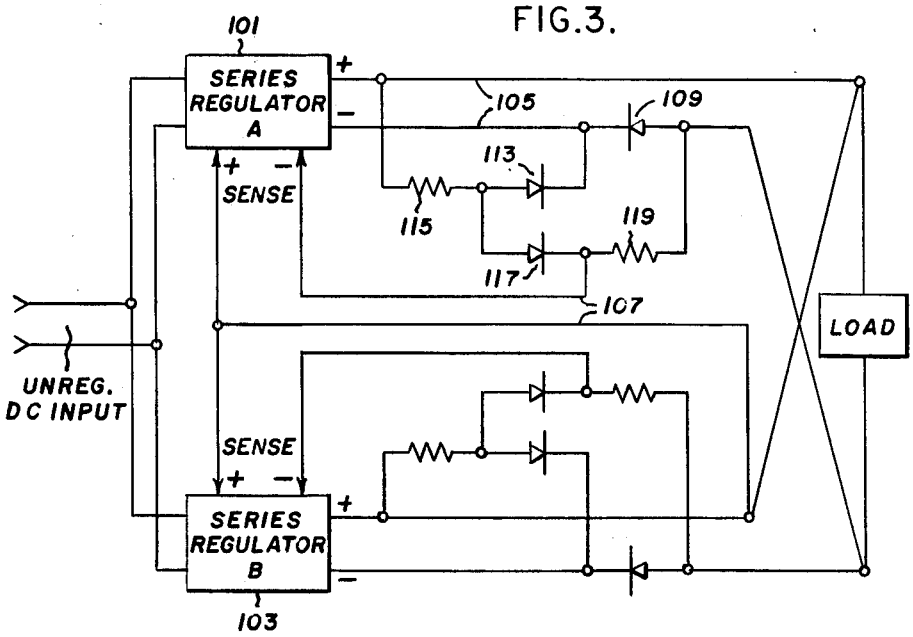
FIG. 3 is an elementary circuit diagram of keep-alive circuitry suitable for application to a power supply system similar to that of FIG. 1 but incorporating series regulators rather than switching regulators.

In FIG. 3 two parallel connected regulators 101 and 103 are illustrated, together with their associated keep-alive circuitry. Each of the series regulators 101 and 103 comprises the usual load output terminals and "sense" return terminals, to which the load conductors 105 and sense leads 107 respectively are connected. As indicated, one of the two load conductors includes a decoupling diode 109, which serves to isolate a failed regulator in the manner previously explained.

On the input side of the decoupling diode there is connected a series combination of a diode 113 and resistor 115, between which is connected one side of another such diode-resistor combination 117–119. The latter has its other side connected to the load conductor 105 on the load side of the decoupling diode 109. The positive "sense" lead connects to the positive load conductor at some convenient point adjacent to the load, and the negative "sense" lead connects to the point of connection of diode 117 and resistor 119 as shown, similarly to the keep-alive circuitry arrangement in the embodiment of FIGS. 1 and 2.

In operation of the embodiment of FIG. 3, when the particular regulator to which the keep-alive circuitry just described is connected is supplying the load there will be no current flow through diode 117 because the two voltages on its opposite terminals are substantially equal, being both approximately one diode drop below the regulator output voltage. More particularly, the voltage on the anode of diode 117 is below the regulator output voltage by the voltage drop of the decoupling diode 109, while the voltage on the cathode of diode 117 is below the regulator output voltage by the voltage drop of diode 113. When no current flows through diode 117, the voltage on the negative "sense" return lead then stands at approximately the load voltage, being connected thereto via resistor 119, and the regulator operates in normal manner to adjust its output as necessary to maintain the load voltage at the set value.

Whenever the voltage output of one regulator is low but the load voltage remains at the set value, with the load current being supplied by the other of the two regulators, the voltage on the cathode side of diode 117 in the keep-alive circuit of the non-loaded regulator then will drop, permitting current flow from the load through that diode with a resultant change in the control voltage applied to the negative "sense" return lead. The non-loaded regulator will respond to this change in its sense input to increase its output and maintain a keep-alive voltage output by the regulator which in this embodiment will be approximately one diode drop or less below the voltage necessary to maintain the load voltage at its set value. Typically this will be of the order of 0.7 volts below the regulator output voltage when supplying the load, which is sufficiently close to full output voltage to effectively minimize the transient seen by the load when picked up by a regulator previously on standby.

DC voltage regulators are offered commercially both in versions accepting DC input directly and in AC input versions incorporating, as part of the regulator, the rectification and filtering elements necessary for AC-DC conversion. It will be appreciated that the control and monitor circuitry of this invention is equally applicable to both such regulator types. It will also be appreciated that current limit and fault detect circuitry similar to that illustrated in FIGS. 1 and 2 may be applied to a series regulator such as shown in FIG. 3 in straightforward manner. Also, the keep-alive and fault detect circuits could if desired be combined in the manner previously described.

While the invention has been described with reference to a specific embodiment, it will be appreciated that many modifications such as those described above may be made by those skilled in the art, and it is intended by the appended claims to cover all such modifications and changes as fall within the true spirit and scope of the invention.

What is claimed and desired to be secured by Letters Patent of the U.S. is:

1. A redundant DC power supply system comprising:

(a) a plurality of voltage regulators having a combined power rating in excess of the anticipated load by an amount at least equal to the power rating of at least one of the regulators, each of said regulators having an input for connection to a power source, an output for connection to a load, and control means including a voltage control input for controlling the regulator output to the load;

(b) supply and load conductor means for connecting said regulators in parallel with each other between a source of unregulated input voltage and a common load;

(c) unidirectional current flow means interposed in one of said load conductor means between each of said regulators and said common load for permitting current flow to the load from at least the one of said regulators having the highest output voltage and preventing current flow from the load to any other of said regulators;

(d) keep-alive circuit means associated with at least one of said regulators including first diode and first resistance means connected in series relation with each other across said conductor means between said one regulator and said load with the point of connection to the one of said load conductor means having interposed therein said unidirectional current flow means being on the regulator side thereof, and second diode and second resistance means connected in series relation with each other with said second diode means being connected to the point of connection of said first diode and resistance means and said second resistance means being connected to said one load conductor means on the load side of said unidirectional current flow means, whereby current may flow from said load through said second diode means when the regulator output voltage is lower than the load voltage by a predetermined amount; and (e) means responsive to current flow in said second diode means for applying to the voltage control input of said one regulator a control signal effective to cause that regulator to maintain an output voltage of predetermined magnitude relative to its rated output.

2. A power supply system as defined in claim 1, wherein said regulators are of switching type with each regulator being switched at a pulse rate and with pulse duration determined by said control means in response to the control signal applied to said voltage control input.

3. A power supply system as defined in claim 1, wherein said regulators are of series type with each regulator providing a keep-alive voltage output approximately one diode drop or less below the output voltage to the load.

4. A redundant DC power supply system comprising:

(a) a plurality of voltage regulators of switching type having a combined power rating in excess of the anticipated load by an amount at least equal to the power rating of at least one of the regulators, each of said regulators having an input for connection to a power source, an output for connection to a load, and control means including switch drive means for switching the regulator between an on state in which it supplies current to its output and an off state in which it does not;

(b) supply and load conductor means for connecting said regulators in parallel with each other between a source of unregulated input voltage and a common load;

(c) unidirectional current flow means interposed in one of said load conductor means between each of said regulators and said common load for permitting current flow to the load from at least the one of said regulators having the highest output voltage and preventing current flow from the load to any other of said regulators;

(d) voltage control circuit means for each of said regulators each including a reference voltage source, means for sensing the regulator output voltage on the load side of said unidirectional current flow means, and means responsive to difference between the regulator output voltage and the reference voltage to apply a switch drive signal to the input of said switch drive means;

(e) keep-alive circuit means for each of said regulators including first diode and first resistance means connected in series relation with each other across said conductor means between said one regulator and said load with the point of connection to the one of said load conductor means having interposed therein said unidirectional current flow means being on the regulator side thereof, and second diode and second resistance means connected in series relation with each other with said second diode means being connected to the point of connection of said first diode and resistance means and said second resistance means being connected to said one load conductor means on the load side of said unidirectional current flow means, whereby current may flow from said load through said second diode means when the regulator output voltage is lower than the load voltage by a predetermined amount; and (f) means responsive to current flow in said second diode means for applying to said switch drive input of the associated regulator a switch drive signal effective to cause that regulator to maintain an output voltage of predetermined magnitude substantially lower than that maintained by said voltage control circuit means.

5. A power supply system as defined in claim 4 further including current limit means, said last-named means comprising current sensing means associated with each of said regulators and operable to sense current flow between the associated regulator and said load, and means responsive to said current sensing means for applying to said switch drive input of the associated regulator a drive signal effective to switch the regulator off when the current magnitude exceeds a predetermined limit.

6. A power supply system as defined in claim 4, further including common voltage adjust means for said regulators, said voltage adjust means comprising a source of DC voltage connected in common to the inputs of the switch drive means of all said regulators, and means for adjusting the level of the DC voltage input applied by said source thereby to adjust the regulated voltage output of said regulators to the load.

7. A power supply system as defined in claim 4 wherein said voltage control circuit means and said keep-alive circuit means have their respective outputs connected together and to the input of said switch drive means, and wherein said keep-alive circuit means further includes capacitance means connected in parallel circuit relation with said first resistance means to form therewith an RC circuit having a relatively long time constant such that the circuit does not respond to variations in voltage output of the regulator when switching under control of said voltage control circuit means.

8. A power supply system as defined in claim 7, wherein said switch drive means includes positive feedback means operative to hold the regulator in its on state for at least a predetermined minimum time period after switching on, which period is relatively short as compared to the period determined by the time constant of said RC circuit.

9. A power supply system as defined in claim 7, further including voltage monitor means comprising third diode and third resistance means connected in series relation with each other across said conductor means between said one regulator and said load, capacitance means connected in parallel with said third resistance means to form therewith a second RC circuit having a time constant substantially longer than that of said RC circuit of said keep-alive circuit means, and fault indicator means connected between said third diode and third resistance means for indicating persistence of low voltage at such point of connection which continues for a time period determined by said second RC circuit.

* * * * *